US006032890A

United States Patent [19]

DesRosiers

[11] Patent Number: 6,032,890

[45] Date of Patent: Mar. 7, 2000

[54] STACKING STABLE YARN CARRIER FOR PACKAGE DYEING

[75] Inventor: Victor J. DesRosiers, Kinderhook, N.Y.

[73] Assignee: Sonoco Development, Inc., Hartsville, S.C.

[21] Appl. No.: 09/093,163

[22] Filed: Jun. 8, 1998

Related U.S. Application Data

[63] Continuation of application No. 08/717,697, Sep. 23, 1996, abandoned.

[51] Int. Cl.[7] ..... B65H 75/28

[52] U.S. Cl. ..... 242/125.1; 242/118.1; 242/125.2; 242/125.3; 242/604; 242/605; 68/198

[58] Field of Search ..... 242/118.1, 118.11, 242/118.3, 125.1, 125.2, 125.3, 605, 604; 68/198

[56] References Cited

U.S. PATENT DOCUMENTS

| | | | |
|---|---|---|---|
| 974,127 | 11/1910 | Daniell et al. . | |
| 1,515,823 | 11/1924 | Benoit . | |
| 2,071,090 | 2/1937 | Simonds . | |
| 2,489,465 | 11/1949 | Russell . | |
| 2,818,222 | 12/1957 | Scholl . | |
| 3,107,067 | 10/1963 | Atwood et al. . | |
| 3,425,110 | 2/1969 | Willis . | |
| 3,465,984 | 9/1969 | Tigges et al. . | |
| 3,561,696 | 2/1971 | Hahm . | |
| 3,563,491 | 2/1971 | Hahm . | |
| 3,647,156 | 3/1972 | Henning | 242/118.1 |
| 3,740,976 | 6/1973 | Fyans . | |
| 3,753,534 | 8/1973 | Ono et al. . | |
| 3,756,532 | 9/1973 | Draper . | |
| 3,759,460 | 9/1973 | Fyans . | |
| 3,759,461 | 9/1973 | Draper . | |
| 3,775,234 | 11/1973 | Rich . | |
| 3,815,887 | 6/1974 | Curtis . | |
| 3,826,444 | 7/1974 | Hahm . | |
| 3,827,652 | 8/1974 | Burchette, Jr. . | |
| 3,929,301 | 12/1975 | Fyans . | |
| 3,960,341 | 6/1976 | Thelen . | |
| 4,027,831 | 6/1977 | Rottleb . | |
| 4,050,645 | 9/1977 | Burchette, Jr. . | |
| 4,050,646 | 9/1977 | Burchette, Jr. . | |
| 4,056,860 | 11/1977 | Ono . | |
| 4,101,374 | 7/1978 | Nebel . | |

(List continued on next page.)

FOREIGN PATENT DOCUMENTS

| | | |
|---|---|---|
| 276923 | 7/1967 | Australia . |
| 293645 | 9/1967 | Australia . |
| 0 158 323 | 4/1985 | European Pat. Off. . |
| 0 158 324 | 4/1985 | European Pat. Off. . |
| 0 166 227 | 5/1985 | European Pat. Off. . |
| 0 201 794 | 4/1986 | European Pat. Off. . |
| 0 201 826 | 5/1986 | European Pat. Off. . |
| 1 416 340 | 9/1965 | France . |
| 1 492 546 | 6/1967 | France . |
| 2 299 257 | 1/1976 | France . |
| 2 299 257 | 8/1976 | France . |
| 881 490 | 6/1953 | Germany . |
| 1 460 270 | 12/1968 | Germany . |
| 1 635 084 | 7/1971 | Germany . |

(List continued on next page.)

*Primary Examiner*—Donald P. Walsh
*Assistant Examiner*—Minh-Chau Pham
*Attorney, Agent, or Firm*—Alston & Bird LLP

[57] ABSTRACT

The invention provides yarn carriers for package dyeing of yarns which include an improved transfer tail engaging and segregating surface on the exterior of an axially projecting nesting collar. The transfer tail engaging and segregating surface is formed by a plurality of axial protrusions which are arranged to form a circumferentially interrupted surface on the axially projecting nesting collar. As a result of the protrusions, transfer tail windings are forced to be formed in an overlapping criss-cross manner which provides for improved access by dye liquor to the transfer tail windings. In addition, the radial protrusions can be provided of a height to form a positive engagement with the inside surface of a female nesting collar of an adjacent yarn carrier.

24 Claims, 4 Drawing Sheets

U.S. PATENT DOCUMENTS

| | | | |
|---|---|---|---|
| 4,108,396 | 8/1978 | Engel . | |
| 4,176,811 | 12/1979 | Becker et al. . | |
| 4,180,219 | 12/1979 | Becker et al. . | |
| 4,181,274 | 1/1980 | Burchette, Jr. . | |
| 4,270,710 | 6/1981 | Ono . | |
| 4,272,037 | 6/1981 | Becker et al. . | |
| 4,331,305 | 5/1982 | Marquis . | |
| 4,349,165 | 9/1982 | Henning et al. . | |
| 4,373,685 | 2/1983 | Hutchinson et al. . | |
| 4,379,529 | 4/1983 | Nielsen . | |
| 4,385,480 | 5/1983 | Burchette, Jr. . | |
| 4,402,474 | 9/1983 | Henning . | |
| 4,433,815 | 2/1984 | D'Agnolo . | |
| 4,441,665 | 4/1984 | Hahm . | |
| 4,454,734 | 6/1984 | Marquis et al. . | |
| 4,667,895 | 5/1987 | Becker et al. . | |
| 4,702,433 | 10/1987 | Gilljam et al. | 242/118.1 |
| 4,941,621 | 7/1990 | Pasini . | |
| 4,946,114 | 8/1990 | Becker et al. . | |
| 4,997,141 | 3/1991 | Pasini . | |
| 5,169,087 | 12/1992 | Romagnoli | 242/118.1 |
| 5,441,208 | 8/1995 | Millen et al. | 242/125.1 |
| 5,445,335 | 8/1995 | Hallmann et al. . | |
| 5,501,406 | 3/1996 | Henning | 242/118.11 |
| 5,577,677 | 11/1996 | Frings et al. | 242/118.11 |
| 5,820,049 | 10/1998 | Atkinson et al. | 242/118.1 |
| 5,942,114 | 8/1999 | Rieker | 68/198 X |

FOREIGN PATENT DOCUMENTS

| | | |
|---|---|---|
| 7 102 230 | 7/1971 | Germany . |
| 1635088 | 10/1971 | Germany . |
| 2 102 816 | 8/1972 | Germany . |
| 23 60 782 | 6/1975 | Germany . |
| 24 08 949 | 9/1975 | Germany . |
| 75 16 449 | 9/1975 | Germany . |
| 26 56 326 | 12/1976 | Germany . |
| 27 30 875 | 1/1979 | Germany . |
| 28 10 163 | 9/1979 | Germany . |
| 21 22 965 | 1/1980 | Germany . |
| 30 19 320 | 5/1980 | Germany . |
| 30 16 015 | 11/1980 | Germany . |
| 80 10 977 | 11/1980 | Germany . |
| 22 41 683 C2 | 10/1981 | Germany . |
| 203 300 | 11/1981 | Germany . |
| 24 52 127 C3 | 2/1982 | Germany . |
| 30 36 247 A1 | 5/1982 | Germany . |
| 28 45 053 C2 | 7/1982 | Germany . |
| 84 16 028 U | 5/1984 | Germany . |
| 84 11 284 | 8/1984 | Germany . |
| 88 11 285 | 8/1984 | Germany . |
| 85 14 349 U | 8/1985 | Germany . |
| 85 30 967 | 2/1986 | Germany . |
| 30 49 632 C2 | 12/1986 | Germany . |
| 55-36441 | 8/1955 | Japan . |
| 45-12049 | 5/1970 | Japan . |
| 46-8586 | 3/1971 | Japan . |
| 46-8587 | 3/1971 | Japan . |
| 46-32459 | 9/1971 | Japan . |
| 47-6587 | 2/1972 | Japan . |
| 47-6756 | 3/1972 | Japan . |
| 47-34994 | 9/1972 | Japan . |
| 47-50038 | 12/1972 | Japan . |
| 48-4173 | 2/1973 | Japan . |
| 48-15717 | 5/1973 | Japan . |
| 52-31469 | 8/1977 | Japan . |
| 53-2968 | 2/1978 | Japan . |
| 54-30417 | 9/1979 | Japan . |
| 55-4671 | 1/1980 | Japan . |
| 55-527 | 1/1980 | Japan . |
| 55-56954 | 4/1980 | Japan . |
| 55-34112 | 9/1980 | Japan . |
| 55-143267 | 10/1980 | Japan . |
| 55-160362 | 11/1980 | Japan . |
| 56-2701 | 1/1981 | Japan . |
| 56-52828 | 12/1981 | Japan . |
| 56-55172 | 12/1981 | Japan . |
| 57-49864 | 3/1982 | Japan . |
| 57-17827 | 4/1982 | Japan . |
| 57-58558 | 4/1982 | Japan . |
| 57-85771 | 5/1982 | Japan . |
| 57-29380 | 6/1982 | Japan . |
| 57-90364 | 6/1982 | Japan . |
| 60-20310 | 5/1985 | Japan . |
| 61-15023 | 4/1986 | Japan . |
| 251098 | 10/1948 | Switzerland . |
| 482306 | 3/1938 | United Kingdom . |
| 1001852 | 8/1965 | United Kingdom . |
| 1 113 676 | 5/1968 | United Kingdom . |
| 1169962 | 11/1969 | United Kingdom . |
| 1 363 363 | 8/1974 | United Kingdom . |
| WO80/02832 | 12/1980 | WIPO . |

STACKING STABLE YARN CARRIER FOR PACKAGE DYEING

This application is a continuation of application Ser. No. 08/717,697, filed on Sep. 23, 1996, now abandoned.

FIELD OF THE INVENTION

The invention relates to yarn carriers for package dyeing. More particularly, the invention relates to perforated yarn carriers in the form of perforated tubes as are used in package dyeing, and which include a transfer tail bunch engaging surface.

BACKGROUND OF THE INVENTION

Yarn carriers for package dyeing have been traditionally formed as perforated tubes or axially compressible springs. A package of yarn is wound onto the carrier and the carrier-supported yarn package is mounted coaxially on a post in a package dyeing machine. Additional yarn packages are then stacked on the post, one above the other with or without spacers between adjacent packages, until the post is filled. Pressure is typically applied to the yarn packages on each post and the package dyeing machine is then sealed and dye liquor is pumped into, and out of, the posts supporting the yarn packages. As a result, dye liquor is pumped through the yarn packages supported on the posts and the yarn in the yarn packages is uniformly dyed.

When the yarn packages are supported on spring carriers, the spring carriers are axially compressed just prior to the dyeing operation. This is accomplished by applying a substantial axial pressure to a full stack of dye spring-supported yarn packages positioned on a dyeing post. Sufficient pressure is applied to partially collapse each of the dye springs which causes the individual yarn packages to contact each other at their adjacent axial ends. The resultant stack of yarn packages then takes a visible form similar to a single elongated yarn package. This well known dyeing process provides more even dyeing of yarns in many instances.

For many years, both rigid carriers (which are not collapsed during dyeing) and spring carriers for package dyeing of yarn were formed of metal, typically stainless steel. with the advent of structurally stable plastic materials over the past decades, construction of carriers for yarn package dyeing has increasingly been based on the use of plastic materials such as polyolefins, nylon, polyesters and the like. Rigid carriers for package dyeing of yarns have been constructed as perforated plastic tubes, generally the same as with prior perforated metal tubes, but typically including structural modifications for strengthening of the perforated plastic tubes because of the weaker structure of plastics as compared to metals. In the case of dye springs, plastic carriers are formed in various structures including structures using a plurality of straight or curved bendable ribs or rib-like structures distributed longitudinally along the length of the yarn carrier and evenly around the circumference of the carrier. Axial pressure applied to the plastic spring carrier results in bending or folding of the ribs resulting in the compression and axial shortening of the spring carrier.

In prior practice, dyed yarn packages were normally transferred to a different yarn carrier prior to downstream operations for forming the dyed yarn into end products such as cloth. Because of various improvements in package winding and dyeing processes, rewinding operations between package dyeing and end product formation have been eliminated in many cases so that in these instances the same yarn package carrier is used in dyeing and in the end product forming process. Such yarn packages have become known as "direct ship" packages.

Textile intermediate and end products such as beams, cloth, thread and the like, are generally formed from a plurality of yarn packages which are tied together to provide a generally continuous single yarn having a total length the same as the plurality of packages. This has long been accomplished by forming a yarn transfer tail on a portion of the yarn package carrier during the beginning of the yarn winding operation. The transfer yarn tail generally comprises a plurality of turns or windings of the yarn, sometimes called a "bunch", which are segregated from the main yarn package at a special location on the yarn carrier, normally at one end of the carrier. In a knitting, weaving or other yarn conversion process, the transfer tail from a first package (constituting the tail end of that package) is tied to the starting end of the following yarn package so that during the conversion operation, when the yarn on the first package is exhausted, the conversion operation is transferred to the next package by the transfer tail of the first package so that the conversion operation continues without interruption.

Because the yarn transfer tail must be generally accessible during the subsequent yarn conversion operation, the transfer tails are normally found at or adjacent one end of a yarn carrier. Typically, the transfer tail bunch is segregated from the main yarn package by means of a groove. The groove entraps the transfer tail bunch because the groove has a smaller circumference than the outside surface of the rest of the carrier and also because of the sidewalls of the groove. However, in the case of dye springs, collapse of the yarn carrier during the package dyeing operation causes the disappearance of the exposed ends of the yarn carrier because these ends are compressed toward each other and ultimately become disposed beneath the ends of the yarn package.

Accordingly, transfer tail bunches on dye springs, if formed on the ends thereof, can be difficult to separate from the main package following dyeing. In order to avoid this problem, in many cases the transfer tail is not formed on the surface of the yarn carrier during winding. Instead, the transfer tail is formed on a nesting collar which extends axially from one end of the yarn carrier. The nesting collar has a smaller outside diameter than the outside diameter of the main body portion of the carrier. Traditionally, such collars have been used to ensure a proper engagement and axial alignment of axially stacked yarn packages during dyeing and transport of the packages. This is achieved by inserting the axially extending, smaller diameter, nesting collar on one end of a first yarn package into the interior of a larger female collar on the opposite end of an adjacent yarn carrier so that the two yarn carriers are aligned and stably joined to each other. A plurality of such carriers can be axially stacked to provide for stable stacking during dyeing and easy transport of empty carriers or carriers bearing yarn packages following a winding or dyeing operation. Stable stacking of yarn packages can also provide a substantial space savings during transportation of the packages because a single pallet can be used to support a plurality of stacked layers of yarn packages.

Yarn carriers having various modifications to facilitate nesting during dyeing and/or transportation are disclosed for example in U.S. Pat. No. 2,489,465 to Russell; U.S. Pat. No. 4,946,114 to Becker et al.; U.S. Pat. No. 4,331,305 to Marquis et al.; and U.S. Pat. No. 4,270,710 to Ono. Dye spring carriers having an axially extending smaller diameter nesting collar including a transfer tail groove on the nesting collar are disclosed in U.S. Pat. No. 4,702,433 to Gilljam et al.; U.S. Pat. No. 4,941,621 to Pasini; and U.S. Pat. No. 4,997,141 to Pasini. In these yarn carriers, the axially extending collar having the yarn tail groove formed thereon extends into the interior of an adjacent yarn carrier during a dyeing operation.

Although entrapment of the transfer tail bunch within a groove on a nesting collar of a dye spring can maintain the transfer tail bunch separate during a dyeing operation, various other difficulties are created by this arrangement. Specifically, in order that the transfer tail bunch be stably retained in a transfer tail groove, several windings of yarn must be orovided in the groove in order to generate sufficient friction between the overlapped windings that the tail doesn't simply slip out of the groove during transport of the yarn package. However, it can then be difficult to uniformly dye the overlapped transfer tail windings because the transfer tail bunch is located in a narrow annular space between the nesting collar and the inside surface of an adjacent dye spring during the dyeing operation. The flow of dye through this annular area is generally not the same as the flow of dye through the yarn packages. Moreover, the transfer tail windings are generally oriented in a tight coaxial and overlapping relationship with respect to each other so that contact between the dye liquor and the yarn surfaces can be insufficient to achieve good dyeing, particularly in the lower windings in the groove. Still further, pinching of yarns between the nesting collar and the inside or end surface of the adjacent yarn carrier must also be avoided because pinched yarn surfaces are generally not evenly dyed during a dyeing operation. Moreover, in the case of many delicate yarns, such as low count spun yarns, pinching of the yarn can sever the yarn, thus destroying the transfer tail.

In order to avoid pinching the segment of yarn joining the transfer tail bunch to the main yarn package, various modifications are normally included in dye spring yarn carriers having a transfer tail groove formed on She surface of a nesting collar. Normally, these modifications include the provision of a radial space between the outer surface of the nesting collar and the inside surface of the female collar of the adjacent carrier so that the yarn segment which exits the transfer tail groove is not pinched in the radial direction between the nesting collar and the inside surface of the female collar of the adjacent tube. In addition, an axial space is normally provided between the shoulder joining the nesting collar to the main body of the yarn package, and the bottom end face of the adjacent yarn package. This is normally achieved by the inclusion of axial stops, i.e., axial engagement surfaces, between the two yarn packages. However, the provision of such axial and radial spacing between engaged male and female collars decreases the positive engagement between the nesting collars so that stable axial stacking of adjacent yarn packages is correspondingly more difficult. In addition, yarn carrier modifications to improve the positive engagement between the two larger and smaller nesting collars generally result in the provision of obstructions that can interfere with the flow of dye liquor to the transfer tail windings entrapped by a groove on the male nesting collar, and can also be costly because of the plastic materials needed to provide such positive engagement surfaces and also because of mold modifications that must be carefully and precisely made in order to provide such modifications.

SUMMARY OF THE INVENTION

Yarn carriers provided according to the invention provide yarn transfer tail engaging and segregating surfaces which can provide improved access of dye liquors to a transfer tail during a dyeing operation even though the transfer tail engaging and segregating surface is provided on the surface of a nesting collar which projects into the interior of a female nesting collar on an adjacent yarn carrier. Preferred yarn carriers of the invention provide positive engagement between a circumferential periphery of the transfer tail engaging surface of the nesting collar holding the transfer tail, and the inside surface of an interior or female collar on an adjacent yarn carrier. Preferably the positive engagement is provided at a location axially adjacent a shoulder between the main body of the yarn carrier and the axially projecting nesting collar which improves the axial stacking stability of yarn packages.

Yarn carriers provided according to the invention include a main perforated body portion and an axially projecting collar of smaller diameter than the main body portion of the yarn carrier. A plurality of radially extending protrusions are provided on the exterior surface of the nesting collar and are arranged in spaced relationship to provide circumferential interruptions along a transfer tail engaging portion of the collar. The axial protrusions cause the transfer tail bunch to be wound in a circumferentially nonlinear fashion onto the nesting collar so that the transfer tail windings must be wound in a crisscross fashion on top of each other during the transfer tail forming process. Because the transfer tail windings are forced into the nonlinear winding arrangement, the yarn surfaces of the transfer tail bunch are more readily exposed to dye during a subsequent dyeing operation.

In one preferred embodiment of the invention, at least a portion of the radially extending protrusions are of sufficient height to positively engage the inside surface of the female nesting collar of an adjacent yarn carrier. This allows for positive radial engagement between nested yarn carriers of the invention. Because the yarn tail windings are not entrapped in a yarn tail groove, but are instead entangled with the transfer tail engaging protrusions, a positive interlocking relationship between nested yarn carriers can be achieved while allowing access of dye liquors to the annular space between the nested female and male collars of adjacent yarn carriers. Preferably, the protrusions are tapered in both the axial and the circumferential directions so that a yarn encountering the exterior of the transfer tail engaging protrusion is forced to slide to the bottom thereof, thereby minimizing or eliminating the possibility that the yarn could be pinched when the transfer tail engaging nesting collar is inserted into the female nesting collar of another dye carrier.

The dye carriers provided according to the present invention can be made without substantial modification of existing yarn carrier manufacturing apparatus. In addition, transfer tails can be formed on the nesting collar of a yarn carrier of the invention while being positively retained thereon without modification of yarn winding processes and/or apparatus as are currently used. Nevertheless, the yarn carriers according to the invention can provide for improved and more reliable dyeing of the transfer tail engaged on the nesting collar. In preferred embodiments, yarn packages wound onto yarn carriers of the invention provide for more stable transport of the yarn packages, both prior to and subsequent to a dyeing operation. This is particularly advantageous in connection with the direct ship yarn packages as are becoming more widely used in commerce since transportation of the yarn packages between different operations and/or locations is of significant importance in connection with such yarn packages.

BRIEF DESCRIPTION OF THE DRAWINGS

In the drawings which form a portion of the original disclosure of the invention.

DETAILED DESCRIPTION OF THE PREFERRED EMBODIMENT

Figure 1:
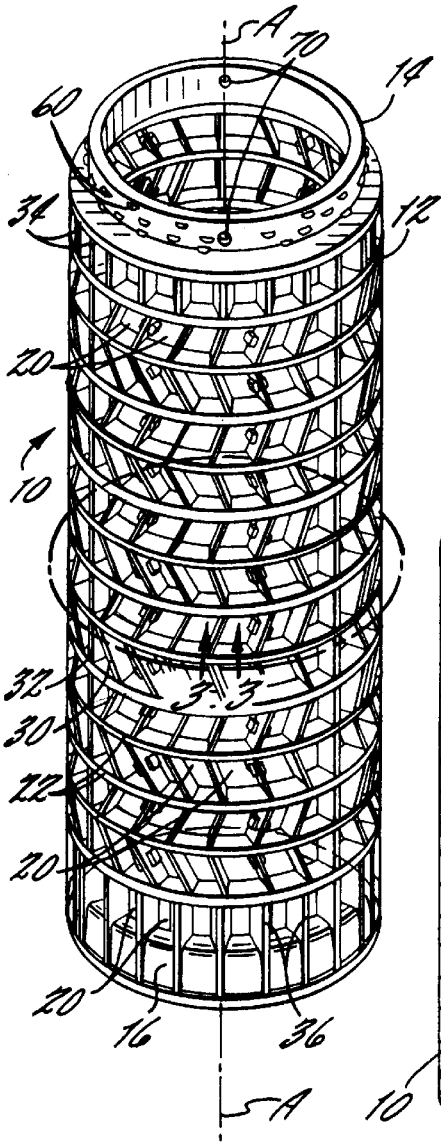
FIG. 1 is a perspective view of one preferred yarn carrier of the invention.

In the following detailed description, a preferred yarn carrier of the invention is described in detail with reference to the accompanying drawings. It will be apparent that the invention can be embodied in many different forms and is not limited to the specific preferred embodiment illustrated in the drawings or described in detail herein. To the contrary, the invention is susceptible to numerous variations and modifications as will become apparent upon consideration of the invention as discussed in the foregoing and described in greater detail below wherein like numbers refer to like elements throughout.

FIG. 1 illustrates a preferred molded yarn carrier 10 of the invention. The yarn carrier is formed by a main bodywall 12 and an upper male nesting collar 14 and a lower female nesting collar 16, best seen in FIGS. 2 and 6. The main body 12 includes a large number of perforations 20 which allow a dye liquor to flow through the bodywall 12.

The various perforations 20 are formed in the spaces between a plurality of axially aligned rings 22 distributed axially along the bodywall, and various rib members 30, 32, 34 and 36 of differing constructions. A first type of ribs 30 are of generally rectangular cross-sectional shape and are aligned in angular relationship with respect to the axis A, of the tube 10. A second type of ribs 32 are also of generally rectangular cross-section and bridge the spaces between adjacent rings 22 and are axially aligned with respect to the axis A of the dye carrier or tube 10. The angled ribs 30 and the axially aligned, or vertical, ribs 32 are distributed along an intermediate portion 40 of the bodywall constituting the majority thereof, best seen in FIG. 3. A third and fourth type of ribs, 34 and 36 have a generally rectangular cross-section and are provided on an upper portion 42 and a lower portion 44, respectively, of the main bodywall 12.

The vertical ribs 32 in the intermediate portion of the bodywall 40 are relatively thin in circumferential width and cooperate with the angled ribs 30 to support the bodywall rings 22 in a first non-compressed relationship. However, upon the application of axial pressure to the end collars 14 and 16, the narrow width of the ribs 32 and 30, together with the angled positioning of the ribs 32 results in the axial compression of the intermediate portion 40 of the main bodywall 12 so that the axial length of the carrier is shortened. A plurality of spacing elements 46 are formed on at least a portion of the angled ribs 32 and determine the spacing between the rings 22 when the tube is in the axially compressed form.

The upper and lower ribs 34 and 36, which are all of axial orientation, do not collapse and remain in a parallel, substantially straight relationship during axial collapsing or compression of the tube bodywall 12. Accordingly, upon axial compression of the bodywall 12, a yarn package 50 supported on the carrier 10 will slide, particularly at the end sections of the bodywall 42 and 44, toward an adjacent yarn package on an axially adjacent carrier until the end faces of two adjacent packages 50 and 52 which were initially in the spaced relationship shown in FIG. 2 move into the end face-contacting relationship shown in FIG. 6. Sliding of the yarn packages is facilitated both by the vertical parallel ribs 34 and 36, and also by the use of a paper or porous cloth sleeve (not shown) positioned radially between the yarn package and the yarn carrier as will be apparent to those of ordinary skill in the art.

Figure 3:
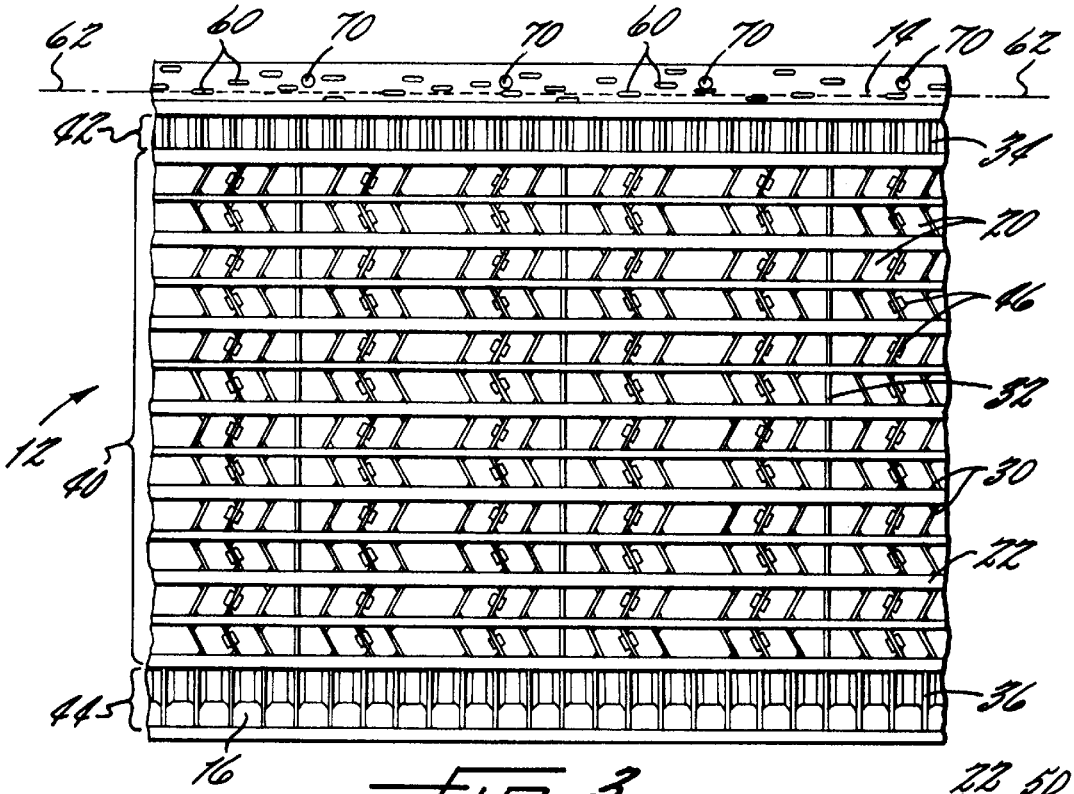
FIG. 3 is an illustration in plan view of the bodywall of the yarn carrier of FIG. 1 in an axially severed and flattened configuration in order to illustrate a preferred arrangement of the radial protrusions on the nesting collar of the yarn carrier of FIG. 1, wherein the protrusions are distributed circumferentially and axially on the nesting collar to provide a circumferentially interrupted transfer tail engaging surface on the collar.

The upper nesting collar 14 extends axially away from the main body 12 of the yarn carrier of the invention as best seen in FIG. 1. As also seen in FIG. 1, a plurality of circumferentially elongate protrusions 60 are distributed circumferentially and axially on the surface of the nesting collar 14. These protrusions define a transfer tail engaging portion of the nesting collar 14. As best shown in FIG. 3, the protrusions 60 are arranged to provide at least one and preferably a plurality of surface interruptions along any generally circumferentially aligned portion of the transfer tail engaging portion of the exterior surface of the nesting collar 14. Thus, a dotted line identifies one circumferentially linear surface portion 62 of the nesting collar 14, and as will be apparent from FIG. 3, the circumferentially linear surface 62 is interrupted by several different protrusions 60. Preferably, substantially all of the entire portion of the nesting collar is circumferentially interrupted; thus, within any circumferentially aligned portion of the transfer tail engaging area, there is preferably at least one surface interruption in the form of a protrusion 60.

Figure 4:
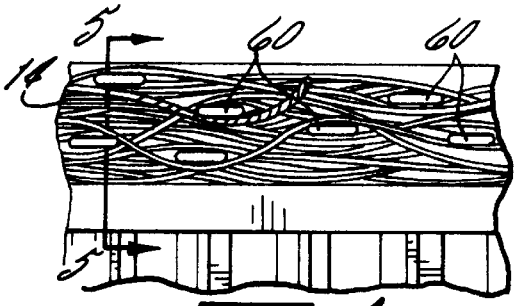
FIG. 4 illustrates a partial, exploded plan view of a portion of the nesting collar of FIG. 1 having a transfer tail bunch engaged thereon and illustrates how the arrangement of radial protrusions in a circumferential surface-interrupting relationship forces the transfer tail windings to be laid onto the transfer tail engaging surface in a random, crisscrossed fashion.

As shown in FIG. 4, the arrangement of the protrusions 60 to provide a circumferentially interrupted transfer tail engagement surface results in the individual transfer tail windings being laid down on top of each other in a substantially random, criss-cross relationship. Thus, the transfer tail windings are retained by entanglement on the transfer tail engaging surface rather than by entrapment within a cavity on the transfer tail engaging surface. This is particularly beneficial in the case of a yarn carrier for dyeing of yarn since the individual transfer tail windings are more readily accessible to dye during a dyeing process than in the case of prior art grooves for entrapping the transfer tail windings. It is preferred that the transfer tail engagement surface include one or more apertures 70, best seen in FIG. 3, in order to further promote dyeing of the transfer tail entrapped on the transfer tail engagement surface.

Figure 2:
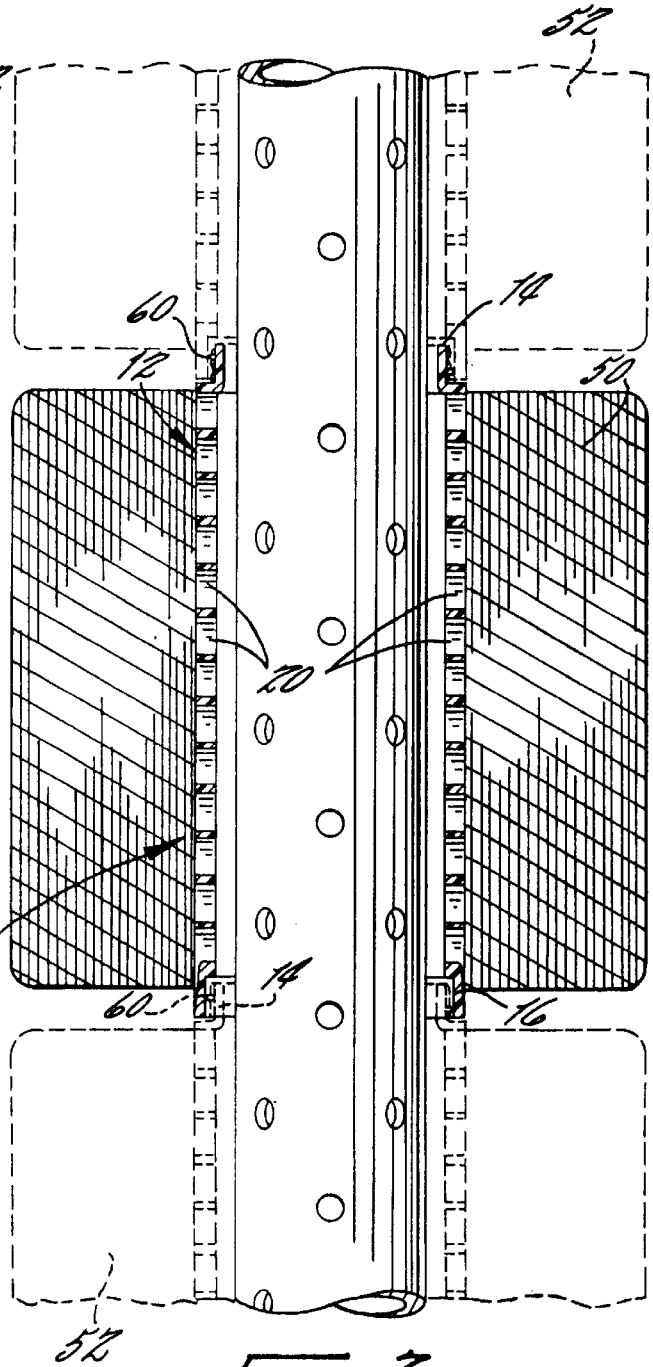
FIG. 2 is a partial cross-sectional view with portions shown in phantom illustrating the yarn carrier of FIG. 1 supporting a full yarn package and mounted on a dye post in a package dyeing machine and being nested into the ends of adjacent upper and lower axially aligned identical yarn carriers, each bearing a yarn package.
Figure 6:
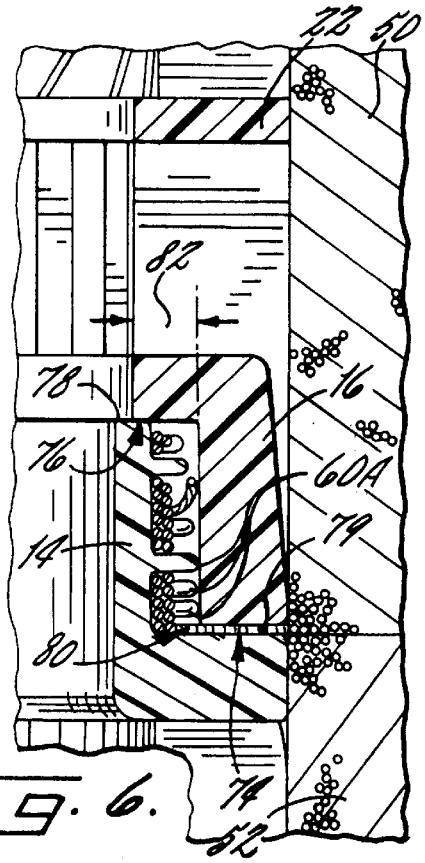
FIG. 6 illustrates a partial, exploded cross-sectional view of nesting collars of two preferred yarn carriers of the invention which are engaged with each other in a nested relationship, and wherein the two carriers have been axially collapsed so that the two yarn packages supported by the respective carriers have been forced into an end-contacting relationship, and also illustrates a transfer tail entangled on the radial protrusions of the upper collar of one of the carriers. The transfer tail is shown positioned in the radial cavity between the nested collars of the yarn carriers and the radial protrusions of the transfer tail engaging collar of the lower carrier are shown to be engaged with the interior surface of the lower collar in an interference fit relationship.

As best seen in FIGS. 2 and 6, the female nesting collar 16 of the yarn carriers of the invention has a vertical height extending between the end surface 74 of the collar and an upper axial end surface 76 of the female collar which is preferably less than the axial height of the axially projecting male nesting collar 14. Thus, the height of the male nesting collar 14 between the axial end surface 78 of the nesting collar 14 and the axial end surface 79 of a shoulder between the main body portion 40 of the yarn carrier and the nesting collar 14, is preferably slightly larger than the axial height of the female nesting collar 16 as seen in FIG. 6. This provides a small axial space 80 seen in FIG. 6 between the axial end surface of the female nesting collar and the shoulder 79 of the main body of the yarn carrier which allows the transfer tail to exit the annular space between the male and female collars.

Figure 5:
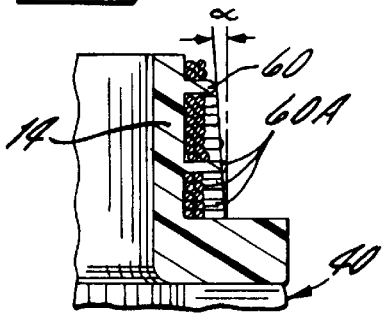
FIG. 5 is a cross-sectional view of the nesting collar of FIG. 4 and illustrates a plurality of radial protrusions of different heights on the nesting collar in a preferred vertical relationship to provide for an interference fit with the interior of the larger, bottom collar of an identical yarn carrier.

Another substantial benefit provided by the transfer tail engagement surfaces of the subject invention is that the protrusions 60 can be constructed to provide positive engagement with the radially interior surface of the female collar of an adjacent dye carrier as best seen in FIGS. 5 and 6. Specifically, as shown in FIGS. 5 and 6, it is preferred that all or a portion of the protrusions 60 have a sufficient radial height that they contact the interior surface of the female nesting collar of an adjacent yarn carrier. Thus, protrusions 60A are shown in FIGS. 5 and 6 to be of sufficient radial height to contact the interior surface of the female nesting collar 16 of the adjacent yarn carrier. More preferably, the protrusions are constructed to have varying height along the axial length of the nesting collar in order to provide an interference fit between axially stacked yarn carriers.

Protrusions of a staggered height to provide an interference fit are shown in FIGS. 5 and 6. As best seen in FIG. 5, the height of the protrusions on the nesting collar 14 are continuously decreasing in the axial direction away from the main body 40. The heights of the protrusions taper between a lowest height and a greatest height in a substantially continuous fashion to provide a draft angle $\alpha$ shown in FIG. 5, which can range from 1° up to about 20° or more, but is preferably between about 2° and about 10°. Generally it is preferred that the endmost protrusions, i.e., those most distant from the main body, have a height sufficiently small to provide at least about 0.020 to 0.030 inch or greater clearance between these protrusions and the interior of a nested female collar, which in turn, improves the ease of engagement between the nested collars during stacking or a similar operation.

It is also preferred that the protrusions of greatest radial height, 60A, have a height greater than the radial spacing 82 between the interior of the female collar 16 and the exterior of the male collar 14 as shown in FIG. 6. Accordingly, the protrusions 60A may be slightly bent or deformed at their tip ends when the two collars are engaged with each other.

The preferred construction for the protrusions 60 used for engaging a yarn transfer tail in accordance with the invention advantageously include a tapered profile when viewed in longitudinal cross-section as per FIGS. 5 and 6. This tapered profile eliminates or minimizes the possibility that a portion of the transfer tail would remain engaged with the radial exterior surface of the protrusion and thereafter become pinched between the exterior surface of the radial protrusion and the interior surface of the female collar 16. In addition, it is preferred that the radial protrusions have a greater circumferential width as compared to their axial width as generally shown in FIG. 3. It is further preferred that the axial profile of the protrusions be generally semicircular or semi-oval in cross-section as generally seen in FIG. 1. As will be apparent, the semicircular or semi-oval cross-section also provides for a tapering height in the circumferential direction for the protrusions 60. Like the tapered longitudinal cross-section or height, the tapered axial cross-section of the protrusions 60 provides a yarn engagement surface which encourages the yarn to slide to the bottom of the protrusion and not be firmly engaged with the top of the protrusion.

The dye carriers of the invention can be formed from any of various materials and by any of various processes but are preferably formed by a molding process using any of various thermoplastic or thermosetting polymers, preferably a thermoplastic polymer such as a substantially rigid polyolefin, nylon or polyester, most preferably polypropylene or polypropylene copolymers or terpolymers, or mixtures of the same.

Figure 7:
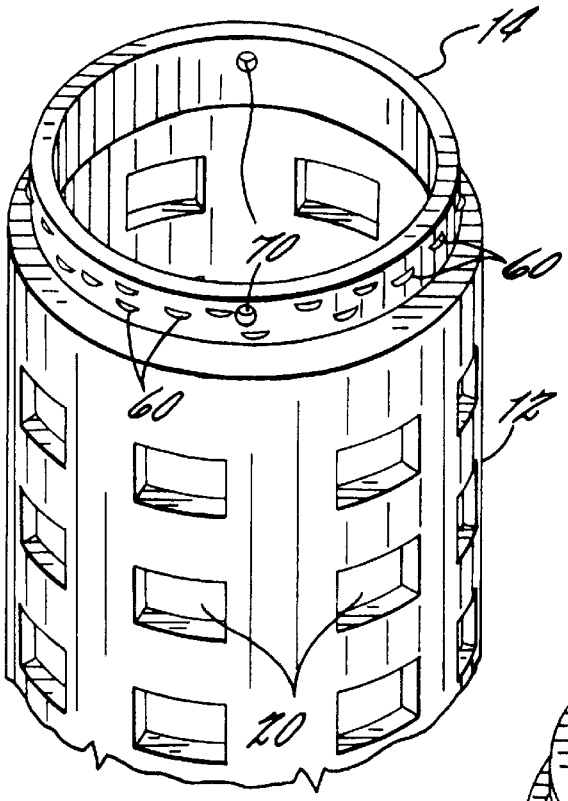
FIGS. 7 and 8 illustrate partial views of rigid dye tubes having transfer tail engaging nesting collars according to the invention.
Figure 8:
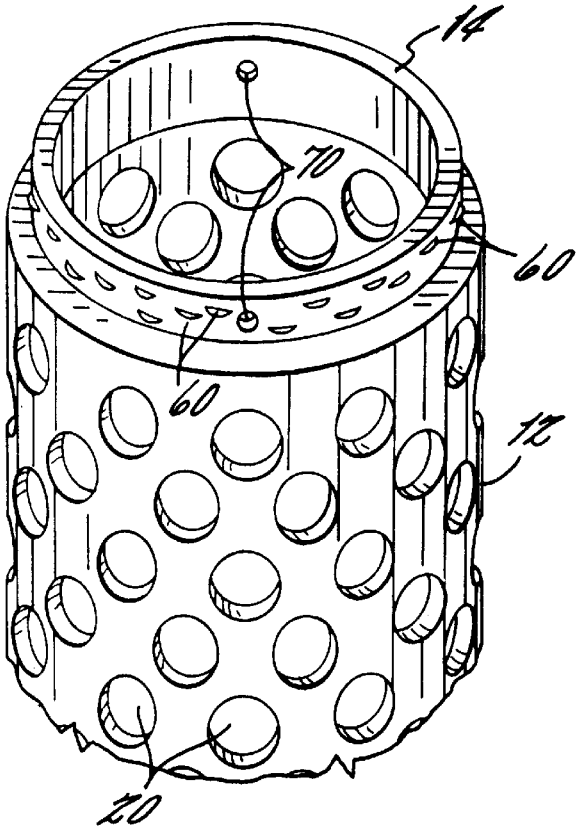

Although the preferred yarn carriers of the invention are designed to be collapsible dye spring type yarn carriers, the invention can readily be used with substantial advantage in connection with any of various noncollapsible or noncompressible yarn carriers for dyeing of synthetic or natural continuous or staple yarns. Two preferred rigid dye carriers are illustrated in FIGS. 7 and 8. As illustrated therein, a main bodywall 12, formed of any of various plastic materials, includes a plurality of perforations 20 distributed along the axial length of the bodywall and circumferentially around the surface thereof. A rigid dye carrier having generally rectangularly shaped perforations 20 is shown in FIG. 7 while a rigid dye carrier having generally circularly shaped perforations is illustrated in FIG. 8. In each case, the rigid dye carrier includes an upper male nesting collar 14 comprising a plurality of protrusions 60 arranged to provide surface interruptions along any generally circumferentially aligned portion of the transfer tail engaging surface of the nesting collar 14. It will be apparent that numerous and various different structures, perforation shapes and the like can readily be employed in providing rigid yarn carriers for dyeing of yarns according to the invention.

Figure 9:
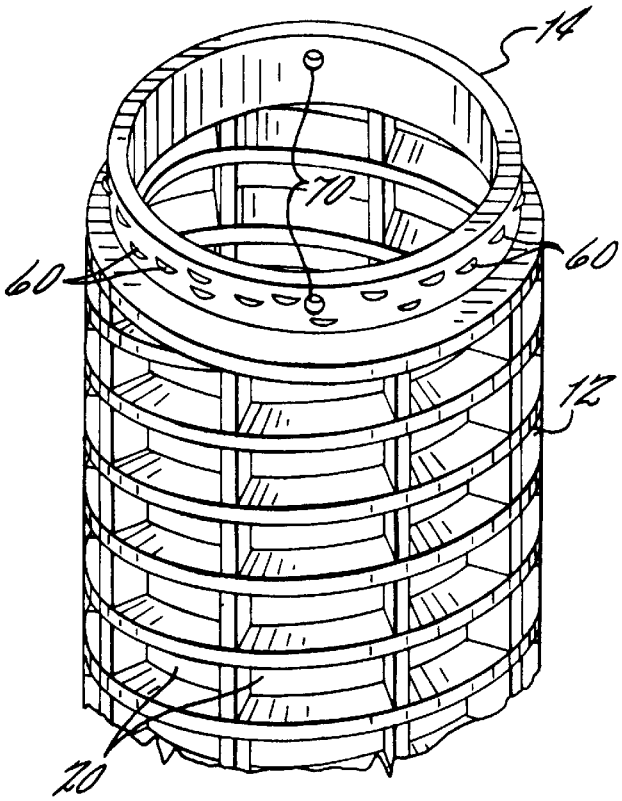
FIG. 9 illustrates an alternative dye spring according to the invention.

Likewise, a wide variety of rib and/or ring constructions can readily be employed to provide axially compressible dye spring type yarn carriers according to the invention as will also be apparent to the skilled artisan. FIG. 9 illustrates one such construction wherein the bodywall 12 of the compressible dye spring is formed by a generally continuous hellically oriented rib which is spaced by a plurality of axially oriented ribs. As will be apparent, numerous and various other dye spring yarn carrier constructions are known to those skilled in the art and can readily be employed in the yarn carriers according to the invention.

Figure 10:
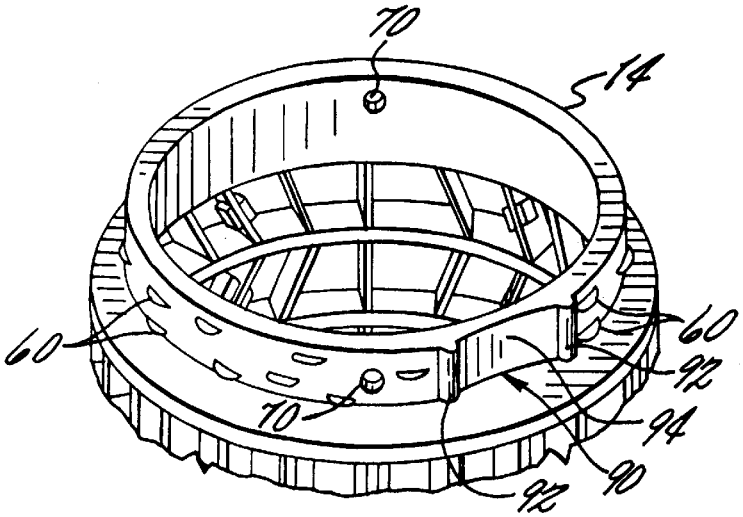
FIG. 10 illustrates another dye tube nesting collar according to the invention which includes a transfer tail grasping surface to facilitate easy removal of the transfer tail from the nesting collar.

FIG. 10 illustrates a transfer tail nesting collar according to the invention which includes a transfer tail grasping surface 90. The transfer tail grasping surface 90 comprises two axially oriented ribs 92 which extend radially outwardly from the transfer tail engaging surface of the nesting collar 14. The two axial ribs 92 are closely spaced from each other in the circumferential direction and preferably there is a radial depression 94 on the portion of the nesting collar 14 located circumferentially between the ribs 92. In use, the two ribs 92 suspend a small portion of a transfer tail bunch radially outward of the surface of the nesting collar so that the transfer tail bunch can be readily engaged by the fingers of an operator or by an appropriate automatic transfer tail engaging apparatus at the time it is desired to unwrap the transfer tail from the nesting collar 14.

The invention has been described in considerable detail with reference to its preferred embodiments. However, numerous changes and modifications can be made without departing from the spirit and scope of the invention as illustrated in the drawings and described in detail in the foregoing specification and defined in the appended claims.

That which is claimed is:

1. A transfer tail engaging and segregating yarn carrier for package dyeing comprising:

a generally tubular perforated main bodywall for supporting a yarn package, said main bodywall having a predetermined exterior diameter; and an axially projecting nesting collar of smaller exterior diameter than said main bodywall, said axially projecting collar comprising a plurality of radially extending protrusions defining a transfer tail engaging surface said radially extending protrusions being arranged in spaced axial and circumferential relationship to form a plurality of circumferential interruptions distributed axially over said transfer tail engaging surface of said nesting collar whereby transfer tail windings wound onto said transfer tail engaging surface are wound in a criss-cross fashion on top of each other during the transfer tail forming process.

2. The yarn carrier of claim 1 additionally comprising a female nesting collar formed at an opposed axial end of said axially projecting collar, said female nesting collar comprising an interior peripheral surface of a diameter greater than the diameter of said axially projecting nesting collar and less than the diameter of said main bodywall.

3. The yarn carrier of claim 2 wherein said female nesting collar has a predetermined axial height and said axially projecting nesting collar has a predetermined axial height and wherein the axial height of said axially extending nesting collar is greater than that of said female nesting collar.

4. The yarn carrier of claim 2 wherein at least a portion of said protrusions on said axially projecting nesting collar have a radial height greater than the difference between the exterior diameter of said axially extending nesting collar and the inside diameter of said female nesting collar.

5. The yarn carrier of claim 4 wherein said protrusions have a continuously decreasing height in a direction axially away from said main bodywall of said yarn carrier.

6. The yarn carrier of claim 1 wherein at least a portion of the perforations of said main bodywall of said yarn carrier are defined by a plurality of axially distributed rings and a plurality of diagonally arranged ribs extending between said rings.

7. The yarn carrier of claim 1 wherein at least a portion of said protrusions have a tapered profile when viewed in radial cross section.

8. The yarn carrier of claim 1 wherein at least a portion of said protrusions have a tapered profile when said yarn carrier is viewed in axial cross section.

9. The yarn carrier of claim 1 wherein said main bodywall is formed of a molded polymer.

10. The yarn carrier of claim 9 wherein said molded polymer is selected from the group consisting of a polypropylene, copolymer and terpolymer thereof.

11. The yarn carrier of claim 1 wherein said yarn carrier is an axially compressible yarn carrier.

12. The yarn carrier of claim 1 wherein said yarn carrier is a rigid yarn carrier.

13. The yarn carrier of claim 1 additionally comprising a transfer tail grasping surface on said axially projecting nesting collar, said transfer tail grasping surface being defined by two circumferentially spaced, axially oriented ribs, each rib extending radially outwardly from said nesting collar.

14. The yarn carrier of claim 13 additionally comprising a radial depression on at least a portion of the exterior surface of said nesting collar positioned circumferentially between said two axial ribs.

15. A transfer tail engaging and segregating yarn carrier for package dyeing comprising:

a generally tubular main bodywall for supporting a yarn package, said main bodywall having a predetermined exterior diameter and comprising a plurality of apertures; and an axially projecting nesting collar of smaller exterior diameter than said main bodywall, said axially projecting collar comprising a plurality of radially extending protrusions defining a transfer tail engaging surface on at least an axial portion thereof, said radially extending protrusions being arranged in spaced axial and circumferential relationship to form a plurality of circumferential interruptions distributed axially over said transfer tail engaging surface;

said yarn carrier additionally comprising a female nesting collar formed at an opposed axial end of said axially projecting collar, said female nesting collar comprising an interior peripheral surface of diameter greater than the exterior diameter of said axially projecting nesting collar; and wherein at least a portion of said protrusions on said axially projecting nesting collar have a radial height equal to or greater than the difference between the exterior diameter of said axially extending nesting collar and the inside diameter of said female nesting collar.

16. The yarn carrier of claim 15 wherein said main bodywall is formed of a molded polymer.

17. The yarn carrier of claim 16 wherein said molded polymer is selected from the group consisting of a polypropylene, copolymer and terpolymer thereof.

18. The yarn carrier of claim 15 wherein said protrusions have a continuously decreasing height in a direction axially away from said main bodywall of said yarn carrier.

19. The yarn carrier of claim 15 wherein said yarn carrier is an axially compressible yarn carrier.

20. The yarn carrier of claim 15 wherein said yarn carrier is a rigid yarn carrier.

21. The yarn carrier of claim 15 additionally comprising a transfer tail grasping surface on said axially projecting nesting collar, said transfer tail grasping surface being defined by two circumferentially spaced axially oriented ribs, each rib extending radially outwardly from said nesting collar.

22. The yarn carrier of claim 15 additionally comprising a radial depression on at least a portion of the exterior surface of said nesting collar positioned circumferentially between said two axial ribs.

23. A transfer tail engaging and segregating yarn carrier for package dyeing comprising:

a generally tubular main bodywall for supporting a yarn package, said main bodywall having a predetermined exterior diameter and comprising a plurality of apertures; and an axially projecting nesting collar of smaller exterior diameter than said main bodywall, said axially projecting collar comprising a transfer tail grasping surface on said axially projecting nesting collar, said transfer tail grasping surface being defined by two circumferentially spaced axially oriented ribs, each rib extending radially outwardly from the exterior surface of said nesting collar.

24. The yarn carrier of claim 23 additionally comprising a radial depression on at least a portion of the exterior surface of said nesting collar positioned circumferentially between said two axial ribs.

* * * * *

UNITED STATES PATENT AND TRADEMARK OFFICE
CERTIFICATE OF CORRECTION

PATENT NO. : 6,032,890

DATED : March 7, 2000

INVENTOR(S) : DesRosiers

It is certified that error appears in the above-identified patent and that said Letters Patent is hereby corrected as shown below:

Title page, after [57] ABSTRACT, "24 Claims" should read --25 Claims--.

Column 9, line 36, after "collar" insert --, said radially extending protrusions being of a shape--; lines 49 and 55, "extending", each occurrence, should read --projecting--; lines 40, 60, and 65, "claim 1", each occurrence, should read --claim 1 or 25--.

Column 10, lines 1, 4, 9, 11, and 13, "claim 1", each occurrence, should read --claim 1 or 25--.

UNITED STATES PATENT AND TRADEMARK OFFICE
CERTIFICATE OF CORRECTION

PATENT NO. : 6,032,890

DATED : March 7, 2000

INVENTOR(S) : DesRosiers

It is certified that error appears in the above-identified patent and that said Letters Patent is hereby corrected as shown below:

Column 12, at the end, insert the following claim:

--25. A transfer tail engaging and segregating yarn carrier for package dyeing comprising:

a generally tubular perforated main bodywall for supporting a yarn package, said main bodywall having a predetermined exterior diameter; and an axially projecting nesting collar of smaller exterior diameter than said main bodywall, said axially projecting collar comprising a plurality of radially extending protrusions defining a transfer tail engaging surface, said radially extending protrusions being arranged in spaced axial and circumferential relationship to form a plurality of circumferential interruptions distributed axially over said transfer tail engaging surface of said nesting collar, said radially extending protrusions being of a shape including a greater circumferential width than an axial width whereby transfer tail windings wound onto said transfer tail engaging surface are wound in a criss-cross fashion on top of each other during the transfer tail forming process.--.

Signed and Sealed this

Sixth Day of February, 2001

*Attest:*

Q. TODD DICKINSON

*Attesting Officer*

*Director of Patents and Trademarks*